United States Patent [19]

Tatum et al.

[11] 4,175,607

[45] Nov. 27, 1979

[54] LATCH PLATE

[76] Inventors: James R. Tatum, 20 Winterton Dr., Islington; Barry R. Dayus, 2021 Ardleigh Rd., Oakville, both of Canada

[21] Appl. No.: 899,284

[22] Filed: Apr. 24, 1978

[51] Int. Cl.[2] ..... E05F 15/20; E06B 3/94

[52] U.S. Cl. ..... 160/1; 160/84 R

[58] Field of Search ..... 160/1, 5, 6, 84 R; 292/121, 128; 16/197; 74/230.01

[56] References Cited

U.S. PATENT DOCUMENTS

| | | | |
|---|---|---|---|
| 3,475,865 | 11/1969 | Arnes | 16/197 |
| 3,907,020 | 9/1975 | Root | 160/1 |
| 3,992,751 | 11/1976 | Foster et al. | 16/197 |

*Primary Examiner*—Peter M. Caun

[57] ABSTRACT

A latch plate for an automatic fire damper intended to be used in ductwork to close such ductwork in the event of fire is formed as a unitary structure. Such a latch plate comprises mutually perpendicular end and side flanges and is integrally formed on its side flange with a transversely projecting, arcuate-sectioned tongue about which there can be wound a spool type tension spring which is operative to move a closure or shutter of such a damper into its closed position on fusion of a mechanical catch mechanism normally holding such a closure in its open position. The side flange of the latch plate is formed with a lateral cam surface along which a terminal blade member of the closure rides as it moves into its closed position and such surface is formed with a pair of ribs on the shutter when that shutter reaches its fully closed position so then releasably to hold the shutter in such closed position, and a novel blade for use in such a fire damper having one symmetrical and one assymetrical hinge part.

8 Claims, 5 Drawing Figures

LATCH PLATE

FIELD OF THE INVENTION

This invention relates to fire dampers and more particularly to fire dampers intended to be installed in ductwork for automatically closing such ductwork in the event of fire so then to prevent or at least delay the spread of fire through such ductwork. The invention also relates to latch plates for use in such fire dampers.

BACKGROUND OF THE INVENTION

It is well known to provide fire dampers in ductwork of heating and air-conditioning systems for the purpose of automatically closing such ductwork in the event of fire so to prevent the spread of such fire within such ductwork through a building. Such automatic fire dampers generally comprise a closure or shutter which is normally retained in an open position by a mechanical catch mechanism which is automatically released when the temperature reaches a predetermined value so as then to allow such a shutter to move into a closed position in which it closes the ductwork to prevent or at least delay the passage of fire therethrough.

Such thermally actuable fire dampers as heretofore known normally comprise latch plates for engaging their shutters when those shutters are moved into their closed positions, as on release of the catch mechanisms. Such latch plates serve positively to hold the shutters in their closed positions further to reduce the possibility of the passage of fire therepast.

The latch plates presently used in such automatically operable fire dampers are relatively complex in their construction and are, therefore, relatively expensive to manufacture. For example, it is presently customary to provide on such a latch plate a generally cylindrical member or boss about which a spool type tension spring is wound, such spring being terminally secured to the shutter of the damper and acting to move that shutter into its closed position on thermal release of the shutter-holding mechanism. Such cylindrical members or bosses are normally secured to known latch plates by a riveting operation which inevitably increases the costs of manufacturing such a latch plate.

Additionally, known latch plates for the aforesaid purposes are normally formed with a cam surface along which a leading edge of a shutter is guided during its movement into its closed position. Frequently, it is presently necessary to provide shutter-closing springs in fire dampers and which springs are relatively strong in their action and, therefore, relatively expensive, in order to ensure that there will be no restriction of movement of the shutter during its engagement with such cam surface before it reaches its fully closed position.

It is a principal object of this invention to provide a latch plate for use in an automatic, thermally actuable fire damper of the type hereinbefore described and which latch plate has a relatively simple construction and which can, therefore, be manufactured at a relatively low cost.

A further object of the present invention is to provide a latch plate for use in an automatic fire damper and which latch plate can be manufactured in a single metal stamping operation while still providing not only a cam surface for guiding a fire damper shutter into its closed position but also an anchorage for a spool type tension spring operative to urge such a shutter into its closed position.

A further objective is the provision of a fire damper assembly of smaller overall dimensions, and greater internal free area for air flow than known dampers, by the improvement of the damper blades and hinge mechanism.

SUMMARY OF THE INVENTION

The present invention comprises a latch plate for use in a fire damper and which can be defined as comprising a unitary structure which in turn comprises (a) an essentially planar side flange having an end edge, a first lateral edge extending generally perpendicularly from said end edge, and a second lateral edge; (b) an end flange integrally formed with said side flange along said end edge thereof and projecting perpendicularly from said side flange; and (c) a tongue integrally formed with said side flange and projecting transversely from said side flange in a direction opposite to that of said end flange for supporting a spool type tension spring terminally anchored to a multi blade shutter of such a fire damper for pulling such a shutter into a closed position thereof on thermally actuated release of a catch mechanism normally holding such shutter in an open position thereof with the blade members of such a shutter disposed in a concertina-like configuration, said second lateral edge of said side flange of said latch plate extending from one end of said first lateral edge thereof progressively and angularly away form that first lateral edge toward said end flange of said latch plate to provide a guide surface for a terminal blade member of such a shutter and being formed with at least one notch therein for releasably receiving a projection on such a terminal blade when such shutter is in its closed position.

In accordance with a preferred feature of this invention, a latch plate in accordance therewith usefully also comprises a blade guiding finger integrally formed with the end flange and projecting generally perpendicularly therefrom in spaced apart disposition relative to said second lateral edge of the side flange on a side thereof opposite to the first lateral edge thereof.

The spring-supporting tongue formed on a latch plate in accordance with this invention will usefully have an arcuate sectional configuration with a convex surface thereof facing in the direction of the end flange and additional structural strength is provided if openings are provided through the side flange of such a latch plate at the lateral edges of such tongue.

In general, two mutually spaced apart notches will be provided in the second lateral edge of the side flange of a latch plate in accordance with this invention for receiving two correspondingly spaced projections on such a terminal blade member of such a shutter when such a shutter is in its closed position. Between such two notches, the second lateral edge of such a side flange will normally extend away from the first lateral edge thereof from a first one of such notches to a second one of such notches in the direction toward the end flange of the latch plate.

In addition to providing novel latch plates as hereinbefore defined, the present invention also provides a novel fire damper. The invention, therefore, comprises a fire damper which can broadly be defined as comprising: (a) a quadrilateral frame having first and second mutually parallel side walls and, generally perpendicular thereto, first and second mutually parallel end walls, each of said side walls and said end walls being provided with inwardly projecting first and second guide flanges disposed respectively in mutually spaced apart first and second planes; (b) a shutter comprising a plurality of pivotally interconnected blade members extending between said side walls of said frame between said first and second guide flanges thereof, said shutter being terminally anchored to said first end wall of said frame for movement between an open position in which said blade members are disposed in a folded concertina-like configuration near said first end wall of said frame and a closed position in which said shutter extends completely between said first and second end walls of said frame to close said frame, said shutter being guided during such movement between said first and second guide flanges on each of said side walls; (c) a unitary latch plate which in turn comprises: (i) an end flange secured to said second end wall of said frame in proximity to said first side wall thereof; (ii) an essentially planar side flange integrally formed with said end flange, projecting therefrom in generally parallel disposition to but spaced apart inwardly from said first side wall of said frame, and having an edge surface extending from one end of said side flange in proximity to said first guide flange on said first side wall of said frame progressively and angularly toward said second guide flange on that first side wall in the direction toward said second end wall of said frame for guiding a free end one of the blade members of said shutter during its movement into said closed position thereof, at least one notch being provided in said edge surface of said side flange of said latch plate for receiving a corresponding projection on said free end one of said blade members when said shutter is in said closed position thereof; and (iii) a tongue integrally formed with said side flange and projecting transversely therefrom toward said first side wall of said frame; (d) a spool type tension spring encircling said tongue of said latch plate and terminally secured at a free end thereof to said shutter to urge said shutter into said closed position thereof and said projection then into said notch; and (e) a thermally actuable catch mechanism on said frame and normally engaging said shutter to hold said shutter in said open position thereof against the action of said spring but releasable in the event of an increase in the temperature of said catch mechanism above a predetermined value to release said shutter and to allow said shutter to move into said closed position thereof under the action of said spring.

A fire damper in accordance with this invention will normally be provided with two such latch plates, the second such plate having a said end flange thereof secured to said second end wall of said frame in proximity to said second side wall thereof with said integrally formed and essentially planar side flange thereof projecting therefrom in generally parallel diposition to but spaced apart inwardly from said second side wall of said frame with said edge surface thereof being transversely aligned with said edge surface of said side flange of the latch plate disposed in proximity to said first side wall of said frame and for simultaneously guiding said free end of said blade members of said shutter during its movement into its closed position and also being provided with at least one notch for receiving a corresponding projection on said free end one of said blade members when said shutter is in said closed position thereof.

The invention also comprises a novel blade and hinge formations thereon, one hinge part being of symmetrical cylindrical shape, and the other hinge part being of assymetrical shape comprising a cylindrical section, and a planar section.

The various features of novelty which characterize the invention are pointed out with particularity in the claims annexed to and forming a part of this disclosure. For a better understanding of the invention, its operating advantages and specific objects attained by its use, reference should be had to the accompanying drawings and descriptive matter in which there are illustrated and described preferred embodiments of the invention.

DESCRIPTION OF THE PREFERRED EMBODIMENTS

Figure 1:
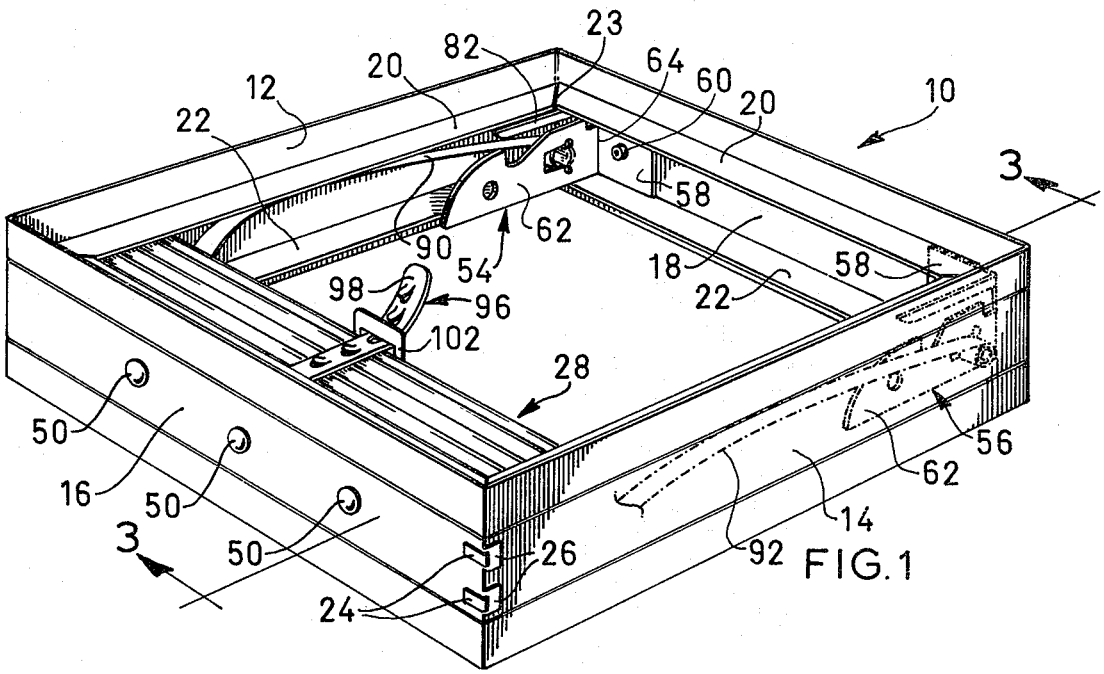
FIG. 1 is a perspective view of a fire damper embodying the invention with parts shown and in phantom.
Figure 3:
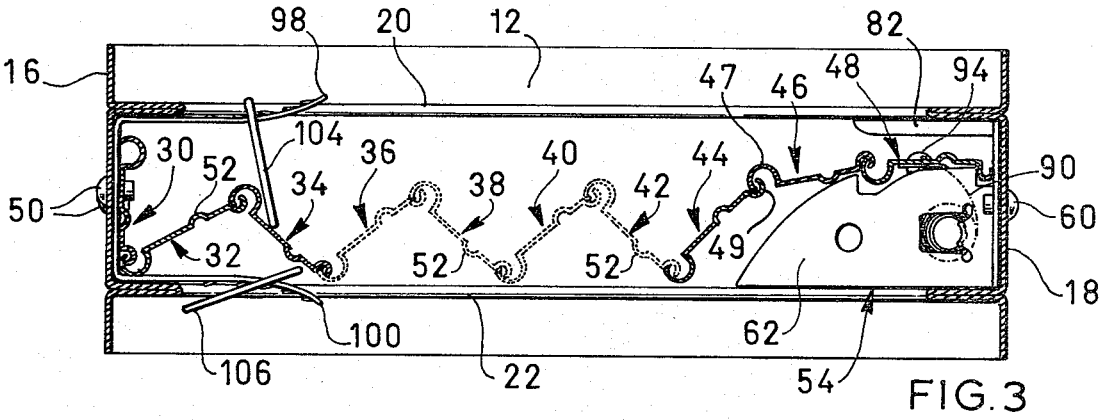
FIG. 3 is a section along line 3—3 of FIG. 1 showing the shutter closed.

In FIGS. 1 and 3 of the accompanying drawings, there is indicated generally by the legend 10 one embodiment of a fire damper in accordance with this invention.

The fire damper 10 comprises a square metal frame including mutually spaced first and second side walls 12 and 14 respectively and mutually spaced first and second end walls 16 and 18 respectively which extend perpendicularly with respect to the side walls 12 and 14. The side walls 12 and 14 and the end walls 16 and 18 is each formed with inwardly projecting first or upper and second or lower guide flanges 20 and 22 respectively, the first or upper guide flanges 20 being disposed in a common first plane and the second or lower guide flanges 22 being disposed in a common second plane spaced downwardly apart from such first plane as will readily be understood from the accompanying drawings.

In the particular fire damper 10 shown in the accompanying drawings, the side walls 12 and 14 and the end walls 16 and 18 with their guide flanges 20 and 22 are formed from a single strip of sheet metal with the guide flanges 20 and 22 being suitably mitred at the corners of the frame as indicated at 23 and with the frame being maintained in its assembled configuration by tongues 24 on the end of the side wall 14 extending through openings in tongues 26 on the end of the first end wall 16 and such tongues being bent over as shown in FIG. 1.

The damper 10 also comprises a movable closure or shutter generally indicated at 28 and comprising a plurality of pivotally interconnected blade members 30,32,34,36,38,40,42,44,46 and 48. The blade members 30 through 48 are pivotally interconnected by transversely extending hinge part 47 and herein hinge part 49 as shown and described in more detail so that the shutter 28 can move between the open position shown in FIG. 1 and closed position shown in FIG. 3. In the open shutter position shown in FIG. 1, such blade members are disposed in a folded concertina-like configuration near the first end wall 16 of the frame of the damper 10. In its closed position, as shown in FIG. 3, the shutter 28 closes the frame completely. It will be noted that the first blade member 32 is secured to the first end wall 16 of the frame by rivets 50. It will also be noted that each of the aforementioned blade members is formed between its edges with a rib 52 which serves to provide additional structural strength to such rib. The shutter 28 is guided between the upper guide flanges 20 and the lower guide flanges 22 during its movement between the open position shown in FIG. 1 and the closed position shown in FIG. 3.

In accordance with the teaching of this invention, the damper 10 is provided with two latch plates generally indicated at 54 and 56 and of novel construction, the latch plate 56 being shown in phantom outline in FIG. 1. Since the two latch plates 54 and 56 have structures which are identical with the exception that one is a mirror image of the other, the corresponding component parts of the two plates will be identified by the same legends.

Each of the latch plates 54 and 56 comprises a generally planar end flange 58 which is secured, for example, by rivets 60 to the second end wall 18 of the frame of the damper 10. Each such latch plate 54, 56 also comprises an essentially planar side flange 62 which is integrally formed with the end flange 58 and projects perpendicularly from an end edge 64 of such end flange.

The side flanges 62 of the latch plates 54 and 56 extend generally parallel to the first and second frame side walls 12 and 14 respectively but inwardly spaced apart therefrom from said second end wall 18 toward said first end wall 16 and each has an essentially linear first or lower edge generally indicated at 66 and a second or upper edge generally indicated at 68 and which, in the damper disposition shown in the accompanying drawings, extends from an outer or forward end of the lower lateral edge 66 progressively and angularly upwardly and rearwardly from that lower lateral edge 66 toward said end edge 64 of the end flange 58.

During movement of the shutter 28 from its open position shown in FIG. 1 to the closed position shown in FIG. 3, the blade member 48 moves into abutment with the second lateral edges of the side flanges 65 of the latch plates 54 and 56 as will be more readily understood as the description herein proceeds.

Such second lateral edges 68 of the latch plates 54 and 56 are formed with first and second notches 70 and 72 respectively. The notches 70 and 72 are defined by forward notch edges 74 and 76 respectively which extend generally parallel to the end edge 64, ie. perpendicularly, in the embodiment shown to the first lateral edges 66 of the side flanges 62 of the latch plates 54 and 56.

Figure 2:
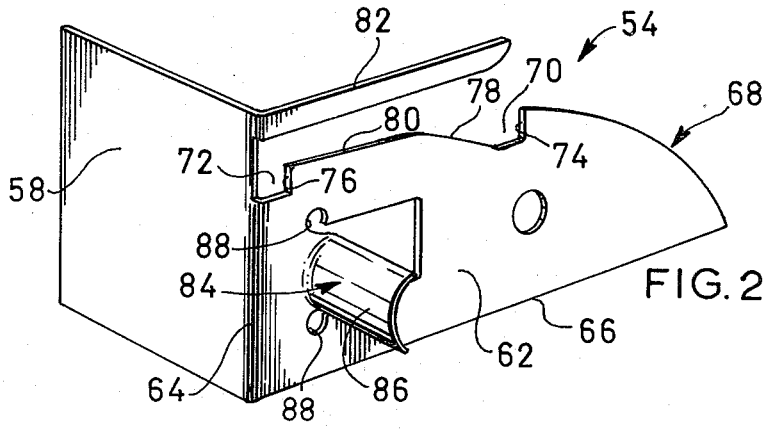
FIG. 2 is a perspective view of latch plate.

From the forward notch 70 to the rearward notch 72, the second lateral edge 68 of the side flange 62 of each of the latch plates 54 and 56 extends angularly upwardly and rearwardly, ie. away from the first lateral edge 66 in two mutually angularly disposed and essentially linear portions 78 and 80 as best shown in FIG. 2.

When the shutter 28 is in its closed position as shown in FIG. 3, the hinge 49 of the blade member 48 is positioned in the notches 72 while the hinge 47 of the blade member 48 is positioned in the notches 70 of the side flanges 62 of the latch plates 54 and 56.

In accordance with another preferred feature of this invention, each of the latch plates 54 and 56 is usefully provided with a finger 82 which extends from the end flange thereof in upwardly spaced apart disposition relative to the second lateral edge 68 to guide the terminal blade member 48 into the position shown in FIG. 3 on closing of the shutter 28.

In accordance with yet another feature of this invention, each of the latch plates 54 and 56 is formed with a tongue generally indicated at 84 and which extends from the side flange 62 in the opposite direction to the end flange 58. For a reason yet to be explained, each tongue 84 usefully has an arcuate sectional configuration with a rearwardly facing convex surface 86. It is also usefully to be noted at this juncture that generally circular openings 88 are provided in the side flanges 62 of the latch plates 54 and 56 at the lateral edges of the tongues 84.

The fire damper 10 shown in FIGS. 1 and 3 also comprises negator type springs 90 and 92, the latter being shown fragmentarily and in phantom outline in FIG. 1 and the former being shown in phantom outline in FIG. 3.

The springs 90 and 92 are terminally secured by rivets 94 to the blade member 48 and, at their opposite ends, such springs spirally encircle the tongues 84 on the side flanges 62 of respective ones of the latch plates 54 and 56 so as to urge the shutter 28 into its closed position as shown in FIG. 3.

During use of the fire damper 10, the shutter 28 is normally held in its open position as shown in FIG. 1 by a thermally actuable catch mechanism generally indicated at 96 and which comprises two toothed arms 98 and 100 to the end wall 16 and between which a compound fusible bar 102 is mechanically held in position. The fusible bar 102 comprises two parts 104 and 106 which are secured together by a low melting point alloy in a conventional manner and which alloy melts when its temperature reaches a predetermined value.

It will now be understood that the fusible bar 102 mechanically held by the two arms 98 and 100 serves to hold the shutter 28 in its open position as shown in FIG. 1. Should the temperature of the fusible bar 102 reach such aforementioned predetermined value as will, for example, occur in the event of a fire in proximity to the fire damper 10, the alloy connecting the two parts 104 and 106 of the fusible bar 102 will melt allowing separation of such parts and release of the shutter 28. The springs 88 will then act to move the shutter 28 toward its closed position shown in FIG. 3.

During such movement of the shutter 28 toward its closed position, the first blade member 48 will move into abutment with the side flanges 62 of the latch plates 54 and 56 and will then be guided over the second or upper lateral edges 68 of these flanges until the forward edge lip 49 of the rearward edge sleeve 47 of the blade member 48 are received in the notches 72 and 70 respectively of such side flanges. During such closing movement of the shutter 28, the blade member 48 is guided into its closed position by the fingers 82.

As hereinbefore indicated, one very important advantage presented by the latch plates 54 and 56 in accordance with this invention is that they can be manufactured easily and at a relatively low cost. It is worth repeating that each such latch plate can be manufactured in a single metal stamping operation in distinction to known latch plates for the same purpose and the manufacture of which generally involves several stamping and/or punching operations and then an additional riveting operation for attaching a boss or cylinder for anchoring of a spring 90 or 92.

In accordance with a particularly preferred feature of this invention, the openings 88 are simultaneously formed during the stamping of the latch plates 54, 56 to minimize the risk of tearing of the side flanges 62 of such latch plates.

Figure 4:
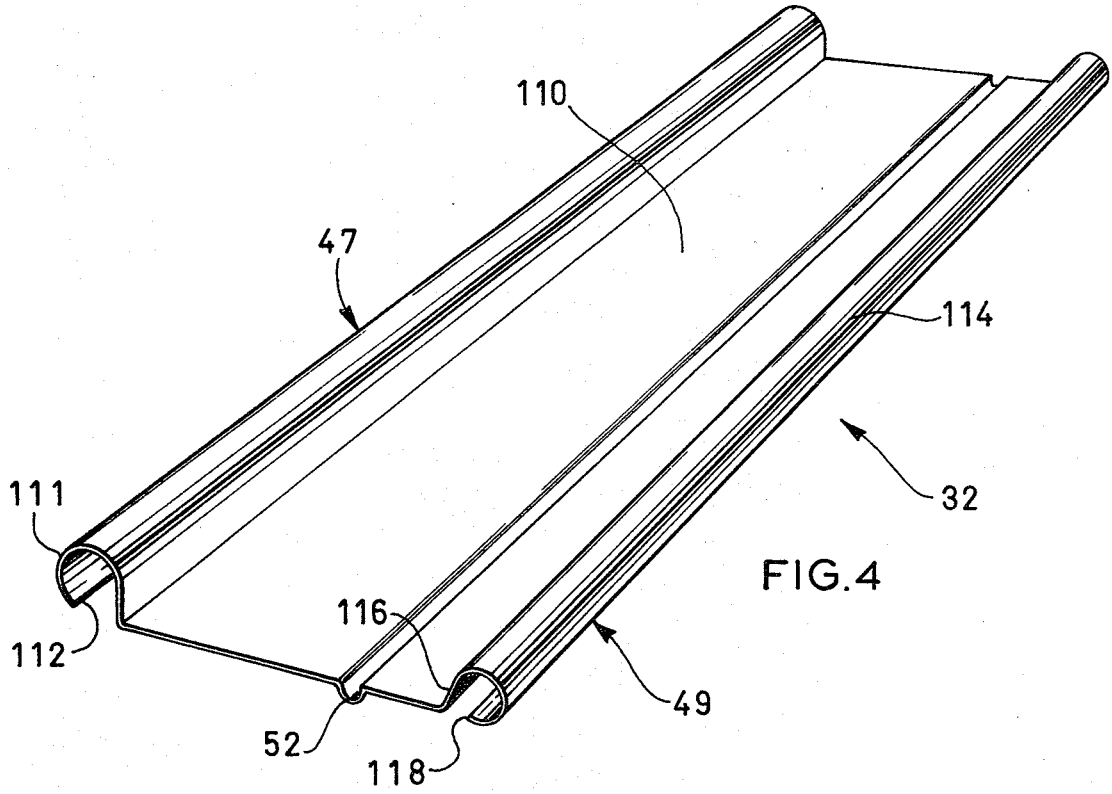
FIG. 4 is a perspective of one of the blades.
Figure 5:
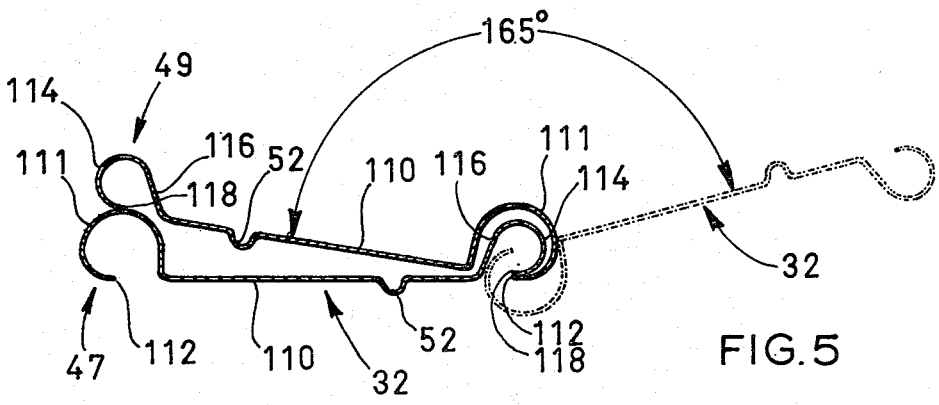
FIG. 5 is an end view showing two blades, in two positions.

As shown in FIGS. 4 and 5, the blades 30 to 48 of the fire damper comprises a flat planar web 110, in which rib 52 is formed, offset downwardly from the plane of web 110.

Along each edge of web 110 the hinge parts 47 and 49 are formed.

Hinge part 47 has symmetrical cylindrical shaped portion 111 and has a free edge 112 terminating in the plane of web 110.

Hinge part 49 is of asymmetrical shape, and comprises a semi-cylindrical portion 114, and a planar locking portion 116, and a free edge 118. Edge 118 is curved slightly inwardly to terminate above the plane of web 110.

In operation the smaller hinge part 49 fits inside the larger part 47 as shown in FIG. 5 when the shutter opens up the edge 112 of part 47 rotates into the interior of hinge part 49 until it contacts the inner surface of semi-cylindrical portion 114. At the same time the outer surface of cylindrical portion 111 contacts planar portion 116. The hinging action is then locked against further rotation. More importantly the two hinge parts 47 and 49 are then so interlocked that they cannot separate. This is particularly important since such shutters may have to withstand heavy battering from high pressure fire hoses, without separating.

While the invention has hereinbefore been specifically described with reference to the particular embodiment thereof as shown in the accompanying drawings, it should be understood that numerous variations in and modifications of the described structure are possible within the scope of this invention.

What is claimed is:

1. A fire damper comprising;

a quadrilateral frame having first and second mutually parallel side walls and, generally perpendicular thereto, first and second mutually parallel end walls, each of said side walls and said end walls being provided with inwardly projecting first and second guide flanges disposed respectively in mutually spaced apart first and second planes;

a shutter comprising a plurality of pivotally interconnected blade members extending between said side walls of said frame between said first and second guide flanges thereof, said shutter being terminally anchored to said first end wall of said frame for movement between an open position in which said blade members are disposed in a folded concertina-like configuration near said first end wall of said frame and a closed position in which said shutter extends completely between said first and second end walls of said frame to close said frame, said shutter being guided during such movement between said first and second guide flanges on each of said side walls;

two unitary latch plates, one at each side of said frame, and fastened to said second end wall thereof, each said latch plate comprising an end flange secured to said second end wall of said frame in proximity to said first side wall thereof; an essentially planar side flange integrally formed with said end flange, projecting therefrom in generally parallel disposition to but spaced apart inwardly from an adjacent said side wall of said frame, and having an edge surface extending from one end of said side flange in proximity to the adjacent first guide flange on said adjacent side wall of said frame progressively and angularly toward said second guide flange on that side wall in the direction toward said second end wall of said frame for guiding a free end one of the blade members of said shutter during its movement into said closed position thereof, at least one notch being provided in said edge surface of said side flange of said latch plate for receiving a corresponding projection on said free end one of said blade members when said shutter is in said closed position thereof; and a tongue integrally formed with said side flange and projecting transversely therefrom toward said adjacent side wall of said frame extending along an axis parallel to the axis of said second end wall, said tongue being formed by stamping out a rectangular portion of said side flange, and being rooted thereto at one end and free at the other end, and being formed with an arcuate cross-section, having a semi-cylindrically shaped surface facing towards said second end wall;

a blade tension spring encircling said tongue of said latch plate and terminally secured at a free end thereof to said shutter to urge said shutter into said closed position thereof and said projection then into said notch; and a thermally actuable catch mechanism on said frame and normally engaging said shutter to hold said shutter in said open position thereof against the action of said spring but releasable in the event of an increase in the temperature of said catch mechanism above a predetermined value to release said shutter and to allow said shutter to move into said closed position thereof under the action of said spring.

2. A fire damper as claimed in claim 1 and in which each said latch plate additionally comprises a bladeguiding finger integrally formed therewith and projecting generally parallel to a respective one of said side walls of said frame in spaced apart disposition relative to said edge surface of said side flange thereof between such edge surface and said second guide flange on a respective one of said side walls of said frame.

3. A fire damper as claimed in claim 2 and in which openings are provided through said side flanges in said latch plates at lateral edges of said tongues thereof.

4. A fire damper as claimed in claim 3 and in which said edge surface of said side flange of each said latch plate is formed with a pair of said notches for receiving a corresponding pair of said projections on said end ones of said blade members of said shutter when said shutter is in said closed position thereof.

5. A fire damper as claimed in claim 4 and in which said edge surface of said side flange of each said latch plate extends away from said first guide flange of a respective said side wall of said frame from a first said notch and toward both a second said notch and said second guide flange of such a said side wall of said frame toward said second end wall of said frame.

6. A fire damper as claimed in claim 5 and in which said edge surface of said side flange of each said latch plate between said notches therein comprises two mutually angularly oriented and generally linear edge portions.

7. A fire damper as claimed in claim 4 and in which each of said notches in said side flanges of said latch plates is defined by two notch edges, each notch edge nearer said first end wall of said frame being essentially perpendicular to the general direction of movement of said shutter when moving from said open position thereof to said closed position thereof.

8. A fire damper as claimed in claim 1 wherein each said blade member comprises a flat planar web portion, an asymmetrical hinge part on one edge of said web, a symmetrical hinge part on the other edge of said web, said asymmetrical hinge part including a flat locking formation interlocking with a said symmetrical hinge part of an adjacent said blade to prevent separation of the blades when the shutter is open.

* * * * *